US006554050B2

(12) United States Patent
Reelfs et al.

(10) Patent No.: US 6,554,050 B2
(45) **Date of Patent: *Apr. 29, 2003**

(54) IRON ALLOY CASTING METHOD AND APPARATUS

(75) Inventors: Edward A. Reelfs, Davenport, IA (US); Billy J. Cagle, Indianapolis, IN (US); Paul T. Cody, Indianapolis, IN (US); D. Gary Wildrick, II, Indianapolis, IN (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 12 days.

This patent is subject to a terminal disclaimer.

(21) Appl. No.: 10/185,787

(22) Filed: Jun. 28, 2002

(65) Prior Publication Data

US 2002/0162639 A1 Nov. 7, 2002

Related U.S. Application Data

(63) Continuation of application No. 09/626,515, filed on Jul. 27, 2000, now Pat. No. 6,463,991.

(60) Provisional application No. 60/142,334, filed on Jul. 2, 1999.

(51) Int. Cl.[7] ..... B22C 1/00

(52) U.S. Cl. ..... 164/5; 164/33; 164/137; 164/529

(58) Field of Search ..... 164/5, 137, 339, 164/341, 394, 395, 396, 409, 33, 529

(56) References Cited

U.S. PATENT DOCUMENTS 2,812,561 A * 11/1957 Hetzel ..... 164/21
2,899,726 A * 8/1959 Hackett ..... 156/580
3,508,598 A * 4/1970 York ..... 164/1

* cited by examiner

*Primary Examiner*—Kuang Y. Lin
(74) *Attorney, Agent, or Firm*—Dennis Kelly Sullivan; Jeffrey P. Calfa; Neil T. Powell

(57) ABSTRACT

Irregularly shaped mold-core assemblies are retained for casting within a thin-wall container by solid particulate material. In the process, the mold and core elements are formed from the core sand. After the mold and core elements, both of which are formed from core sand, are assembled, the assembly is placed in a container large enough to provide space around the assembled mold and core elements, and solid particulate material is placed in the space around the mold-core assembly to hold the assembled mold and core elements together during pouring of the molten iron alloy into the mold-core assembly and the cooling period, during which the molten iron alloy solidifies to form the casting. After the casting is formed, the solid particles and the core sand from the mold elements and core elements are recovered, processed and reused in further casting operations.

8 Claims, 2 Drawing Sheets

IRON ALLOY CASTING METHOD AND APPARATUS

RELATED APPLICATIONS

This is a continuation of application Ser. No. 09/626,515, filed Jul. 27, 2000 now U.S. Pat. No. 6,463,991, which claims the benefit of U.S. Provisional Application No. 60/142,334, filed Jul. 2, 1999 and U.S. Non-Provisional application Ser. No. 09/608,176 filed Jun. 30, 2000, all of which applications are incorporated herein in their entirety.

FIELD OF THE INVENTION

This invention relates to methods and apparatus for use in casting, particularly for use in casting large, irregularly-shaped articles such as engine blocks for internal combustion engines.

BACKGROUND OF THE INVENTION

Traditional casting methods generally employ a "green sand" mold which forms the external surfaces of the cast object and the passageways into which the molten iron alloy is poured for direction into the mold cavity. A green sand mold is a mixture of sand, clay and water that has been pressure formed into the mold element. Green sand molds have sufficient thickness so that they provide sufficient structural integrity to contain the molten metal during casting and thereby form the exterior walls of the casting. The structural integrity of the green sand molds, however, is not completely satisfactory and the green sand can easily yield to the pressure that may be exerted by the hands of a workman.

For example, in casting an engine block, a green sand mold is provided with a cavity and preformed cavity portions to position and hold core elements that form the cylinders, coolant passageways and other internal passageways in the cast engine block.

In such casting methods, the core elements that form the internal passageways of the engine block are formed with a high-grade "core sand" mixed with a curing resin so that core elements may be formed by compressing the core sand-curing agent mixture, and curing the resin while compressed to form core elements that have sufficient structural integrity to withstand handling and the forces imposed against their outer surfaces by the molten metal that is poured into the mold cavity. The core send resin is selected to degrade at temperatures on the order of 300 to 400 degrees Fahrenheit so that the corn sand may be removed from the Interior of the cylinder block after the molten Iron alloy has solidified.

Because of the cost of the core sand, it is desirable that the sand be recovered for further use after it has been removed from the casting. Recovery of the green sand used in the mold is also desirable; however, the large quantities of the green sand-clay mixture can be degraded sufficiently during the casting process that they cannot be economically recycled and must be hauled away from the foundry and dumped. Since the production of such castings is frequently hundreds of thousands of cylinder blocks per year, the cost of handling and disposing of the green sand residue of the casting process imposes a significant unproductive cost in the operation of the foundry. In addition, the core sand frequently becomes mixed with the green sand to such an extent that the core sand cannot be reused in the casting process.

BRIEF SUMMARY OF THE INVENTION

In the invention, a mold and one or more core elements defining the internal passageways of the casting are formed.

After the mold and core elements, both of which are preferably formed from resin bonded sand, are assembled, they are placed in a container that is large enough to provide space around the mold-core assembly, and solid particles are is placed in the space between the mold-core assembly and the container to hold the assembled mold and core elements together during pouring of the molten iron alloy into the mold-core assembly and the cooling period during which the molten iron alloy solidifies to form the casting.

In the process of the invention, a plurality of containers are provided and a plurality of mold-core assemblies are provided. The mold-core assemblies preferably comprise core sand mold-forming elements and core sand core-forming elements. The mold-core assemblies are loaded, one after another, into the containers, and the spaces between the mold-core assemblies and the containers are provided with sufficient solid particulate matter to hold the mold-core assemblies together during the casting operations. The containers, with the retained mold-core assemblies, are transported to a pouring station where the mold-core assemblies are filled with molten metal. The poured mold-core assemblies and containers are then allowed to cool until the castings are formed and are transferred after the cooling period to an unloading station where the containers are inverted, the castings are retrieved and the core sand is removed from the interior cavities of the castings. The core sand and the solid particulate material are recovered and can be used in further casting operations.

The solid particulate material is preferably metal particles, for example, spherical steel shot. Using metal particles permits their reclamation by magnetic separation from the core sand. More preferably, the solid particulate matter comprises metal particles formed with the same metal being used to form the castings. Using the casting metal for formation of the solid particulate material permits the reclamation of particulate matter that is fused together by casting metal that does not enter the mold in pouring and that may escape the mold through its interfaces. Such fused casting-metal particles may be re-melted and recast into new individual particles. In addition, such casting-metal particles may be in the form of multi-pointed particles, such as the shape of jacks used in the child's game.

The assemblage of metal particles around the mold-core assembly helps dissipate the heat from the mold-core assembly, absorbs any casting metal that may escape the mold-core assembly and provides a mold-core assembly support that does not warp in use. Where the metal particles are formed from the same metal being used in the casting operation, metal particles that become fused together by the casting metal may be reclaimed and re-melted (e.g., by "throwing them back in the pot.")

With the invention, the use of green sand can be eliminated by replacing the green sand molds with a combination of inexpensive reusable containers and reclaimable solid particulate materials, and with mold elements and core elements that are formed by core sand. By eliminating the use of green sand, the cost of the green sand and its clay binders, the problems associated with mixing of the green sand and core sand and their respective binders, and the environmental costs of disposing of the excess green sand are eliminated.

Other features and advantages of this invention will be apparent from the drawings and more detailed description of the invention that follow.

DETAILED DESCRIPTION OF THE BEST MODE OF THE INVENTION

Figure 1:
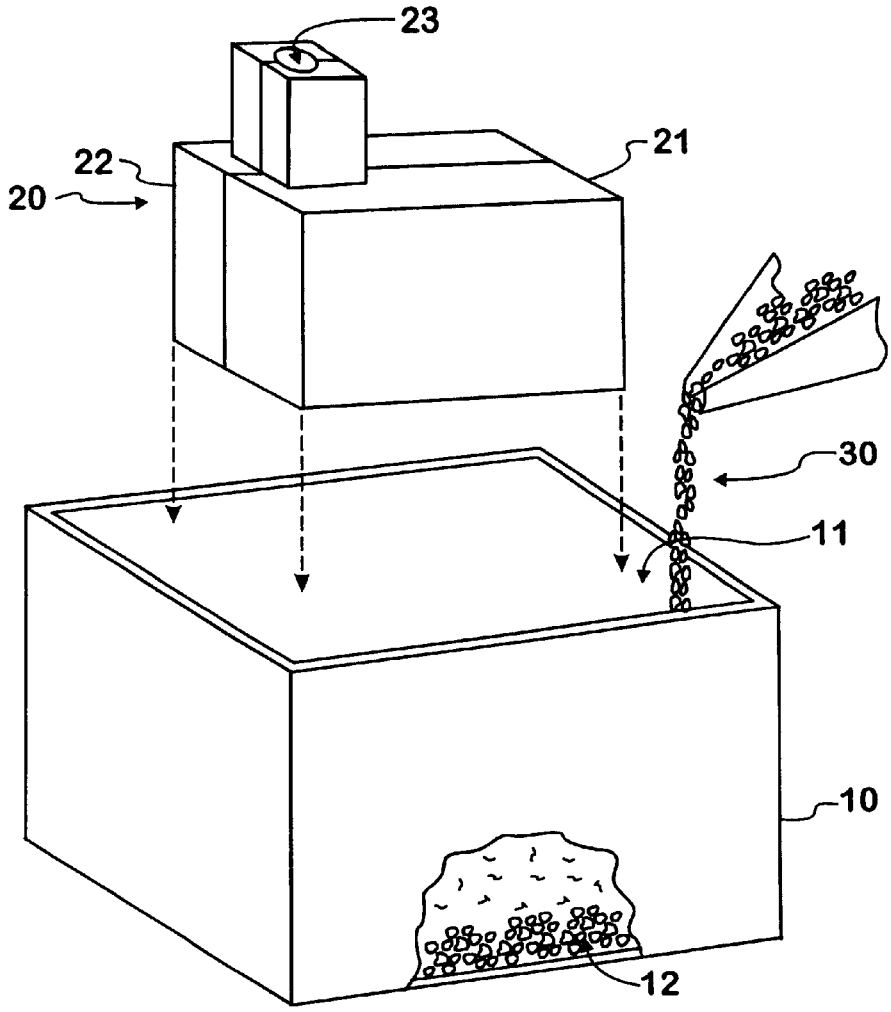
FIG. 1 illustrates, in a perspective diagram, the placement of the mold-core assembly and solid particulate material in a container.
Figure 4:
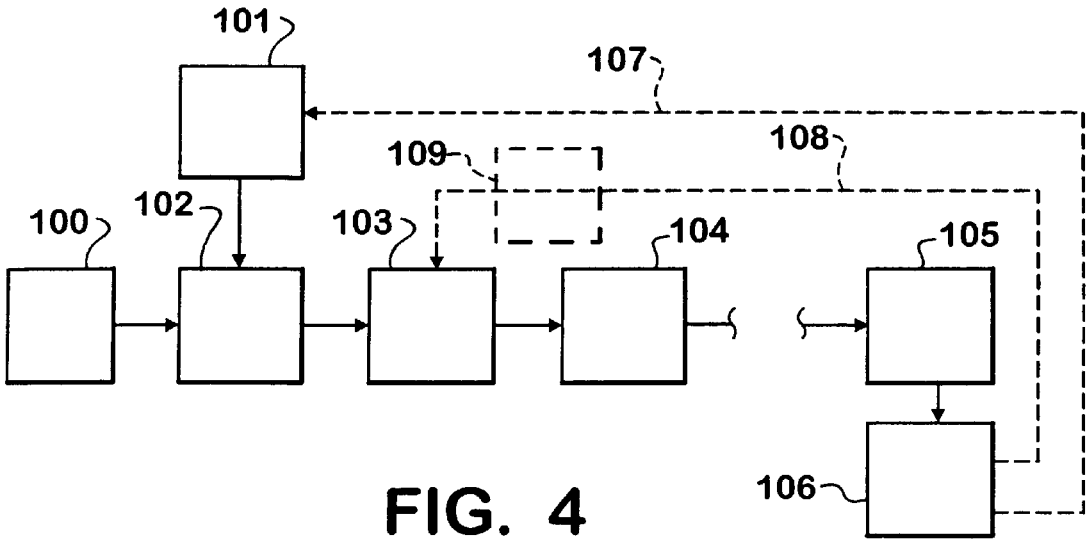
FIG. 4 is a block diagram of the process of the invention.

FIG. 1 is a perspective diagram to illustrate several steps in the process illustrated in the block diagram of FIG. 4. As illustrated in FIG. 1, a container 10 for a mold-core assembly 20 is provided. Such a container 10 can be formed from thin sheet metal, such as ⅛ inch thick steel sheet, with an open top 11.

FIG. 1 illustrates a mold-core assembly 20 including mold elements 21 and 22 that are formed with core sand and resin. As known in the art, the mold elements 21 and 22 may be provided with surfaces to position an inner core assembly (not shown), which can comprise a plurality of assembled core elements, each of which is formed from the core sand used in the mold elements 21 and 22. As further illustrated in FIG. 1, the mold elements 21 and 22 are provided with a passageway 23 into which the molten iron alloy may be poured to fill the mold cavity. Although FIG. 1 illustrates the passageway 23 for the molten iron alloy as being formed in both mold elements 21 and 22, the passageway may be formed predominantly in one mold element.

Figure 2:
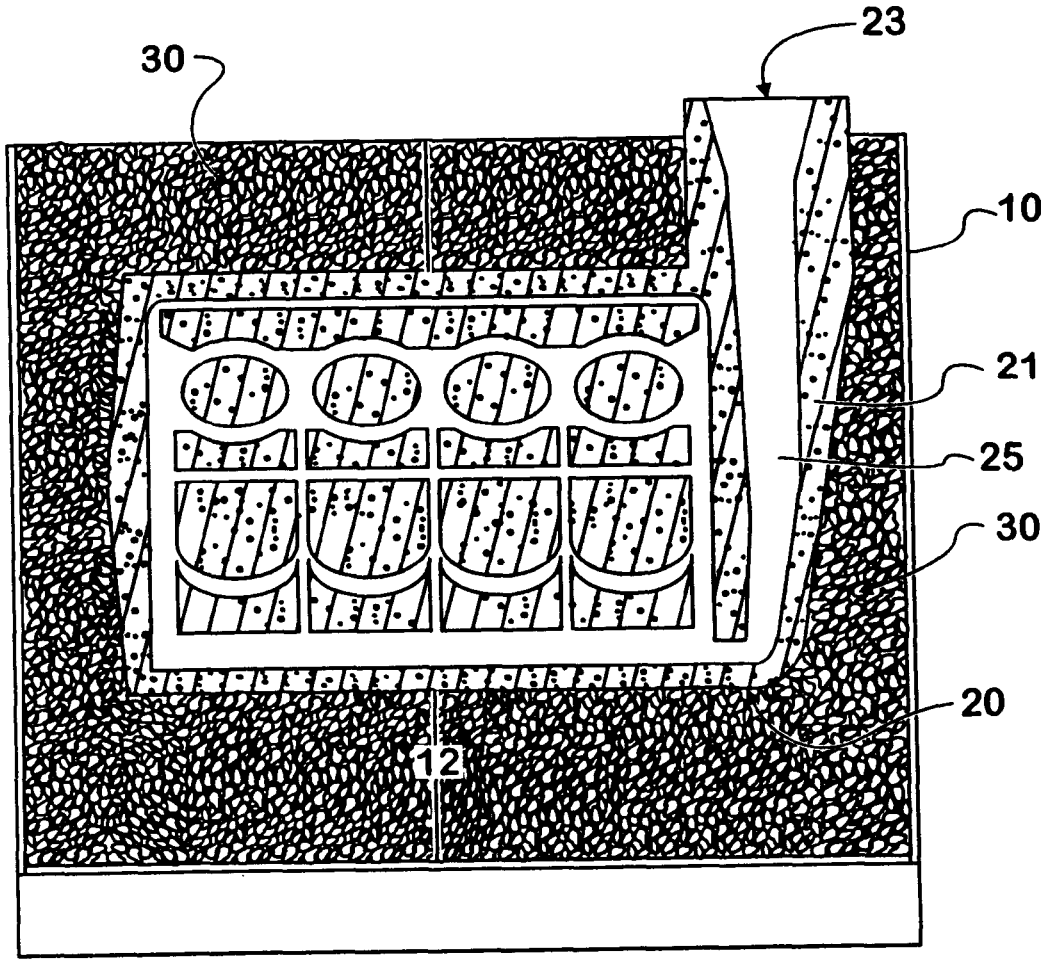
FIG. 2 is a cross-sectional drawing to illustrate the support of a mold-core assembly in a container.

In this invention, the container 10 may be partially filled with solid particulate material to form a layer of solid particles on which the mold-core assembly may rest. Such a layer of particulate matter 12 is illustrated by the cutaway side wall of FIG. 1. The mold-core assembly 20 is lowered through the open top 11 of the container and in the process illustrated by FIG. 1 rests on the layer 12 of solid particulate material. As further indicated by FIGS. 1 and 2, the container 10 is larger than the mold-core assembly. The container 10 is sufficiently larger than the mold-core assembly 20 to provide space on at least two sides of the mold-core assembly, on opposite sides of the mold-core assembly parting line. Preferably, the container 10 is sufficiently larger to provide space on all six sides of the mold-core assembly so it can be surrounded by solid particulate material, as illustrated by FIG. 2. After the mold core assembly is placed on the bed 12 of particulate material, the spaces between the mold core assembly 20 and the container 10 are filled with additional particulate material. FIG. 1 illustrates an addition of particulate material 30 into the space between the mold-core assembly 20 and container 10.

FIG. 2 illustrates a mold-core assembly 20 supported in a container 10 by solid particulate material 30 that fills the space between the mold-core assembly 20 and the container 10. The contained solid particulate material retains the integrity of the mold-core assembly 10 during the addition of the molten iron alloy, which is indicated by element number 25 in FIG. 2. The body of solid particulate material does not permit the mold-core assembly to separate during casting, yet provides open space around the mold-core assembly to assist in dissipating the heat released by the molten material, and permits a simple, thin-walled container 10 to be used in the process. In addition, although the assemblage of solid particulate material 30 is exposed to the heat released by the casting, it has no "structure" to warp.

The solid particulate material 30 is preferably metal and can be spherical steel shot, which is inexpensive, reusable, and can be "poured" easily into the space between the mold-core assembly 20 and the container 10. (See FIG. 1). Preferably, the solid particulate material may be cast from the same iron alloy used in the castings so the metallic particles can be recast if they become fused together with spilled casting metal or casting metal that escapes the mold-core assembly.

Figure 3:
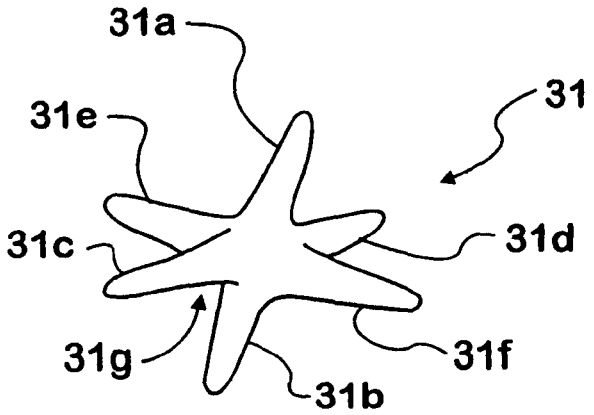
FIG. 3 is a drawing of a preferred form of particle.

FIG. 3 illustrates a possible preferred form of particle 31 for use in the invention. As shown in FIG. 3, such a particle may be multi-pointed, for example, with six points (31*a*–31*f*) projecting from a central junction (31*g*) along 3 orthogonal axes, in a manner similar to the jacks used in the child's game, and preferably cast with the same iron alloy used in the casting operation.

In a preferred form of the process of the invention, as illustrated in FIG. 4, a plurality of thin wall containers 10, illustrated in FIG. 1, are provided in first step 100 of the process, and a plurality of mold-core assemblies 20, also illustrated in FIG. 1, are provided in another first step 101 of the process. The mold-core assemblies 20 are placed in the thin wall containers 10 (See FIG. 1) at step 102 and are transported to a filling station 103 where solid particulate material 30 is provided in the space between the mold-core assemblies 20 and the containers, to hold the mold-core assemblies together during the pouring and cooling stages of the casting operation. The containers 10, with the mold-core assemblies 20 retained therein by the particulate matter 30, are then transported to a pouring station 104 where molten iron alloy is poured into the mold-core assemblies 20 through their pour openings 23. The containers 10 and poured mold-core assemblies 20 are then placed in a holding area for a period, for example, about 45 minutes (illustrated in FIG. 4 by the broken line between steps 104 and 105), to permit the molten iron alloy to solidify and form the castings. After the holding period the containers 10 are moved to an unloading station 105 where the containers are inverted, dumping the casting, the solid particulate material and the remnants of the mold-core assembly for further processing.

In the further processing at step 106, the solid particles 30 are removed from the core sand by screening and/or in the more preferable method of the invention, where the solid particles are metal, such as the iron alloy used in casting, by magnetic separation. The core sand and solid particulate material recovered at step 106 are returned for reuse, the core sand to provide further mold elements or core elements, or both, as shown by line 107, and the solid particulate material for reuse as mold-core assembly supporting material, as shown by line 108. The recovery step may include both screening to separate the core sand from the solid particles and other casting residue and magnetic screening of the recovered core sand to remove metal particulate matter. As indicated by line 107, the recovered core sand may be rehabilitated, for example, by heating to remove any resin residue and by supplying it with further resin before using the recovered core sand to provide the mold-core assemblies at step 101. At step 109 (indicated by the dashed line box adjacent step 103 and on line 108), the invention preferably includes the casting of metal particles 30 from the same metal used at step 104, for use as mold-core assembly supporting material at step 103, and any such recovered metal particles that are fused together as a result of their use may be re-melted for casting new metal particles at step 109.

Other embodiments of the invention will be apparent to those skilled in the art from the drawings and modes of the invention described above without departing from the scope of the claims that follow.

What is claimed is:

1. In a casting method using iron alloys, the improvement comprising providing a container for a mold-core assembly comprising mold elements formed from core sand and core elements formed from core sand, said container providing spaces around the mold-core assembly, and filling the spaces with solid particles to hold the mold-core assembly for casting, wherein the solid particles are formed with same metal being used for forming the casting.

2. The improvement of claim 1 wherein the cast metal particles have a multi-pointed form.

3. A casting method, comprising:

providing a plurality of containers;

providing a plurality of mold-core assemblies comprising mold elements formed from core sand and core elements formed from core sand;

loading the mold-core assemblies, one at a time, into the containers, the containers providing space on at least two sides of the mold-core assemblies;

placing solid particulate matter in the space between the mold-core assemblies and the container;

moving the mold-core assemblies and carriers to a pouring station and pouring molten metal into the mold-core assemblies;

allowing the molten metal to solidify into castings;

unloading the castings, solid particulate matter and mold-core assemblies in an unloading station; and recovering the solid particulate matter and the core sand of the mold elements and core elements for reuse, wherein the solid particulate matter is metal particles, and the metal particles are formed with the same metal being used for forming the casting.

4. The casting method of claim 3 wherein the recovered core sand is rehabilitated for reuse in forming mold elements and core elements.

5. The casting method of claim 3 wherein the metal particles are recovered from the recovered core sand magnetically.

6. The casting method of claim 3 wherein the step of providing a plurality of mold-core assemblies includes the steps of rehabilitating the recovered core sand by the addition of further binder and mixing the recovered core sand and new core sand as needed to form further mold elements and further core elements of the mold-core assemblies.

7. The casting method of claim 3 wherein the recovered core sand is heated to remove resinous material.

8. The casting method of claim 3 wherein the solid particulate matter comprises a plurality of multi-pointed metal particles cast with the same metal used in the castings.

* * * * *